US006305289B1

(12) United States Patent
Mayseless et al.

(10) Patent No.: US 6,305,289 B1
(45) **Date of Patent: *Oct. 23, 2001**

(54) SHAPED CHARGE FOR LARGE DIAMETER PERFORATIONS

(75) Inventors: Meir Mayseless, Haifa (IL); Avigdor Hetz, Houston, TX (US)

(73) Assignee: Western Atlas International, Inc., Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/163,720

(22) Filed: Sep. 30, 1998

(51) Int. Cl.[7] ..... F42B 1/028; F42B 1/032
(52) U.S. Cl. ..... 102/307; 175/4.6
(58) Field of Search ..... 102/307, 476, 102/306–310; 175/4.6

(56) References Cited

U.S. PATENT DOCUMENTS

| | | | | |
|---|---|---|---|---|
| 3,613,582 | * | 10/1971 | Levamaki | 102/306 |
| 3,658,006 | * | 4/1972 | Nistler et al. | 102/307 |
| 3,789,760 | * | 2/1974 | Griffith | 102/306 |
| 3,948,181 | * | 4/1976 | Bergstrom | 102/476 |
| 4,499,830 | * | 2/1985 | Majerus et al. | 102/476 |
| 4,776,272 | * | 10/1988 | Lindstadt et al. | 102/307 |
| 4,776,278 | * | 10/1988 | Scholles et al. | 102/307 |
| 4,841,864 | * | 6/1989 | Grace | 102/307 |
| 4,905,601 | * | 3/1990 | Gabriel et al. | 102/307 |
| 4,942,819 | * | 7/1990 | Thoma et al. | 102/307 X |
| 4,979,443 | * | 12/1990 | Rittel et al. | 102/307 |
| 5,033,387 | * | 7/1991 | Lips | 102/476 |
| 5,155,297 | * | 10/1992 | Lundstadt et al. | 102/476 |
| 5,175,391 | * | 12/1992 | Walters et al. | 102/307 |
| 5,251,561 | * | 10/1993 | Murphy | 102/307 |
| 5,753,850 | * | 5/1998 | Chawla et al. | 102/307 |
| 5,797,464 | * | 8/1998 | Pratt et al. | 175/4.6 |

FOREIGN PATENT DOCUMENTS

| | | | | |
|---|---|---|---|---|
| 3111921 | * | 5/1985 | (DE) | 102/476 |

* cited by examiner

*Primary Examiner*—Harold J. Tudor
(74) *Attorney, Agent, or Firm*—Darryl M. Springs; Keith R. Derrington

(57) ABSTRACT

A shaped charge for generating a large hole in material such as well casing downhole in a wellbore. A shaped charge liner is oriented about a longitudinal axis, and a disk is positioned at the liner apex. When an explosive material is initiated the liner collapses into a perforating jet. The disk alters the jet formation process and changes the shape and location of a bulge within the perforating jet. Consequently, the shape of the perforating jet retains a larger diameter for generating a larger hole in the material to be perforated or for controlling the penetration depth. The disk surfaces can be flat, concave, convex or other shapes, and the disk composition can be varied to accomplish different design criteria.

10 Claims, 2 Drawing Sheets

SHAPED CHARGE FOR LARGE DIAMETER PERFORATIONS

BACKGROUND OF THE INVENTION

The present invention relates to the field of lined explosive charges for perforating targets. More particularly, the present invention relates to a disk shaped component in a shaped charge liner for producing a material penetrating jet to produce a large target perforation downhole in a wellbore.

The invention is particularly useful in the field of downhole well casing perforations. Well casing is typically installed in boreholes drilled into subsurface geologic formations. The well casing prevents uncontrolled migration of subsurface fluids between different well zones and provides a conduit for production tubing in the wellbore. The well casing also facilitates the running and installation of production tools in the wellbore. Well tubing can be installed within well casing to convey fluids to the well surface.

To produce reservoir fluids such as hydrocarbons from a subsurface geologic formation, the well casing is perforated by multiple high velocity jets from perforating gun shaped charges. A firing head in the perforating gun detonates a primary explosive and ignites a booster charge connected to a primer or detonator cord. The detonator cord transmits a detonation wave to each shaped charge.

In a conventional shaped charge, booster charges within each shaped charge activate explosive material which collapse a shaped liner toward the center of a cavity formed by the shaped charge liner. The collapsing liner generates a centered high velocity jet for penetrating the well casing and the surrounding geologic formations. The jet properties depend on the charge case and liner shape, released energy, and the liner mass and composition. Shaped charge jets perforate the well casing and establish a flow path for the reservoir fluids from the subsurface geologic formation to the interior of the well casing. This flow path can also permit solid particles and chemicals to be pumped from the casing interior into the geologic formation during ravel packing operations.

Various efforts have been made to modify the performance of shaped charges. Barriers and voids have been placed within the explosive material to modify the detonation wave shape collapsing the liner. Examples of detonation wave shaping techniques are described in U.S. Pat. No. 4,594,947 to Aubry et al. (1986), U.S. Pat. No. 4,729,318 to Marsh (1988), and U.S. Pat. No. 5,322,020 to Bernard et al. (1984). In each of these patents, detonation wave shapers are positioned in the explosive material between the detonator cord and the liner. In U.S. Pat. No. 5,753,850 to Chawla et al. (1998), a spoiler was positioned within the liner cavity to modify the perforating jet shape.

Other efforts have been made to modify perforating jet performance by changing the liner shape. In U.S. Pat. No. 3,268,016 to Bell (1964), a disk-like appendage in a liner was provided to peen the rough perforation burr after the leading perforating jet portion penetrated through the target. The disk-like appendage was configured to form a slug portion with a diameter larger than the perforating jet entry hole diameter. In U.S. Pat. No. 5,559,304 to Schweiger et al. (1996), a liner having a flattened outer surface for the purpose of stretching and flattening the perforating jet shape. The flattened central region of the liner apex reduced the thickness of the liner between 10–15 percent. The velocity of the perforating jet was reduced to enhance stable flight and end-ballistic performance. In U.S. Pat. No. 4,702,171 to Tal et al. (1987), the liner apex was hollowed, and in U.S. Pat. No. 3,137,233 to Lipinski (1962), a conical liner represented a squared liner apex in one view for the purpose of facilitating the liner manufacture.

One technique for generating a large diameter perforation uses a mandrel to shape the perforating jet shape. In U.S. Pat. No. 4,841,864 to Grace (1989), a mandrel was placed along the liner longitudinal axis to control the perforating jet shape. In U.S. Pat. No. 5,155,297 to Lindstadt et al. (1992), a solid weight member was centrally positioned in the liner to stabilize the deformation of the perforating jet. The weight member extended into the explosive charge and through the liner material.

Another technique for generating a larger perforating hole incorporates a liner having a hemispherical portion attached to a conical skirt. Because the hemispherical portion has a discontinuity in the liner slope, a negative velocity gradient creates a bulge in the material perforating jet which leads to a larger hole in the target material. Although a larger hole is created, the size of the hole is limited by the configuration of the composite liner surfaces.

In certain well completion activities such as gravel packing operations, large diameter well perforations are desirable to facilitate the rapid placement of solid particles into the well. To accomplish this objective, a perforating gun should remove a large target surface area from the casing before the energy of the perforating jet is expended. Conventional shaped charge techniques are limited in their ability to generate large casing holes without significantly increasing the shaped charge size. Accordingly, a need exists for an apparatus that can efficiently create large diameter perforations or minimum penetration in well casing and other selected targets.

SUMMARY OF THE INVENTION

The present invention provides an apparatus actuatable by a detonator to perforate a material. The apparatus comprises an explosive material which can be initiated by the detonator to create a detonation wave, a shaped liner proximate to said explosive material and having a first end facing the detonator and having a second end formed about a longitudinal axis through a hollow space, wherein said shaped liner is collapsible about said hollow space when impacted by said detonation wave to form a material penetrating jet, and a disk proximate to said liner first end and deformable by said detonation wave to modify the material penetrating jet by resisting radial movement of said collapsing liner toward said liner longitudinal axis.

In other embodiments of the invention, the explosive material can be positioned within a housing recess, the disk can be attached to the liner, and the disk can be formed with different materials in different configurations. The disk surfaces can be flat, concave, convex, or other shapes, and the disk can be integrated into the liner.

DESCRIPTION OF THE PREFERRED EMBODIMENTS

As previously described, conventional shaped charges initiate an explosive material to collapse a liner material about a cavity defined by the liner. The collapsing liner material moves radially inwardly toward the longitudinal axis and simultaneously moves outwardly in the direction of the detonation wave to generate a high velocity, perforating jet. Energy from the detonation wave is transferred to the individual particles of the collapsing liner material. The penetration hole diameter of the conventional perforating jet depends on the target composition, the perforating jet diameter, and the energy dissipated radially as the perforating jet penetrates the target material.

The present invention significantly improves conventional large hole penetration capability by creating a substantially larger hole in a target. The invention accomplishes this function by resisting collapse of the liner toward the longitudinal axis, and by maintaining a perforating jet diameter greater than conventional jets.

Figure 1:
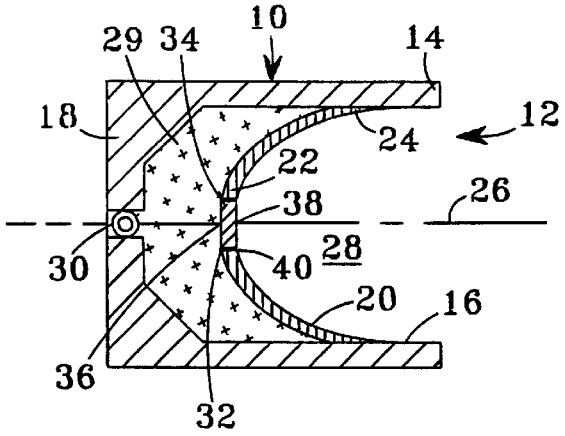
FIG. 1 illustrates a liner and disk proximate to the explosive material in a charge case.

Referring to FIG. 1, charge case or housing 10 defines a recessed cavity 12 having open end 14, housing wall 16, and closed end 18. If the cavity 12 of housing 10 has a parabolic or elliptical shape, wall 16 and closed end 18 are collectively defined by a continuous shaped surface. Liner 20 forms a geometric figure having liner apex 22 and liner base 24 formed about longitudinal axis 26. Liner 20 can be symmetrical about longitudinal axis 26, or can be offset. Liner 20 is positioned within cavity 12 so that liner apex 22 faces housing closed end 18. Liner base end 24 faces toward open end 14. Liner 20 defines an interior volume or hollow space 28 between liner base 24 and liner apex 22.

High explosive material 29 is positioned between housing wall 16 and liner 20. Detonator 30 comprises a primer or detonator cord suitable for igniting high explosive material 29 to generate a detonation wave. Such detonation wave focuses liner 20 to collapse toward longitudinal axis 26 and to form a material perforating jet. As collapsing liner moves 20 towards open end 14 in the same direction as the detonation wave travel, the perforating jet also moves in such direction consistent with the laws of mass momentum and energy conservation. The perforating jet exits housing 10 at high velocity and is directed toward the selected target. Although liner 20 is preferably metallic, liner 20 can be formed with any material suitable for forming a high velocity perforating jet.

Disk 32 is shown in FIG. 1 as a thin, flat circular plate. Disk 32 is located proximate to liner 20 near liner apex 22 and has disk edge 34 and disk surfaces 36 and 38. Disk edge 34 can be circular, oval, rectilinear, or irregular in shape. Disk 32 is positioned within aperture 40 through liner apex 22. As shown in FIG. 1, disk surfaces 36 and 38 are substantially flat and are substantially perpendicular to longitudinal axis 26. In other embodiments of the invention, disk edge 34 can have an oval, irregular, or other shape, and disk surfaces 36 and 38 can be concave, convex, irregular, or another shape.

The mechanism of the perforating jet resulting from disk 32 generally performs as follows. Disk 32 is accelerated by the detonation wave along longitudinal axis 26. Because of the curvature of liner 20, each element of liner 20 is accelerated toward longitudinal axis 26 and forward in a direction parallel to longitudinal axis 26. By being pushed toward longitudinal axis 26 the elements of liner 20 will create a fast moving perforating jet followed by a slug component.

The resulting jet creates a larger hole in the target than conventional jets formed in the absence of a disk. Disk 32 interrupts the normal formation of the perforating jet by interrupting or resisting the inner collapse of liner 20 toward longitudinal axis 26. This change in collapse flow significantly alters the conditions forming the perforating jet component and the slug component. The mass and velocity of the perforating jet do not change materially by altering the final position of the collapse process, but the resulting perforating jet diameter is increased because the jet flow is formed away from longitudinal axis 26 as the residue from disk 32 is accelerated along longitudinal axis 26. The jet hole size, penetration, and other factors can be controlled by the size, mass, thickness, composition, orientation, and other characteristics of disk 32.

Figure 2:
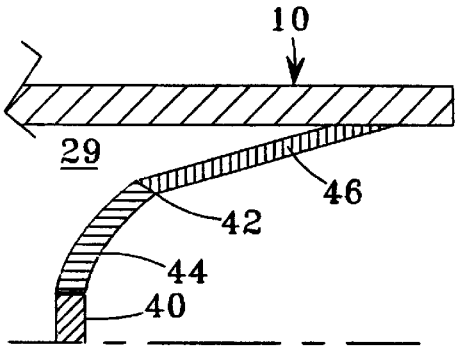
FIG. 2 illustrates a disk integrated within a shaped charge liner.

FIG. 2 illustrates another embodiment of the invention wherein disk 40 is integrated into liner 42. Liner 42 is formed with hemispherical section 44 and conical section 46. The discontinuity in the slope between hemispherical section 44 and conical section 46 creates a bulge in the resulting perforating jet, and this bulge is enhanced by the operation of disk 40 in response to a detonation wave. By having a discontinuity in the second (or higher) derivative of the liner 42 contour, a negative velocity gradient is generated to form the perforating jet bulge. Disk 40 interferes with the perforating jet to increase the size of the hole generated by the resulting perforating jet. The bulge formation can be controlled to modify the shape and location of the bulge relative to the other portions of the perforating jet.

Figure 3:
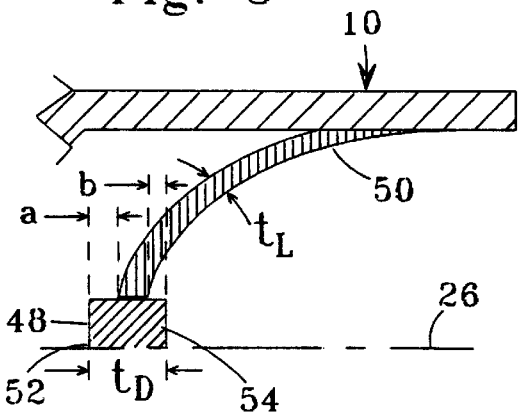
FIG. 3 illustrates a disk having, a greater thickness than the liner.
Figure 4:
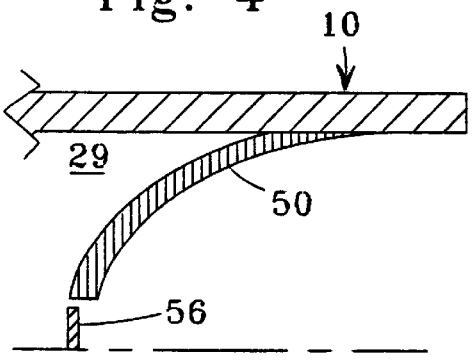
FIG. 4 illustrates a disk having less thickness than the liner.

FIG. 3 illustrates another embodiment of the invention wherein disk 48 has a thickness $t_D$ greater than the thickness $t_L$ of liner 50. As illustrated, surfaces 52 and 54 of disk 48 are offset from liner 50 with dimensions "a" and "b", so that $t_D=t_L+a+b$. In different embodiments of the invention, surfaces 52 or 54 can be flush with the respective surfaces of liner 50, or can be disposed in other positions relative to the respective surfaces along longitudinal axis 26. The position of liner 50 along longitudinal axis 26 can be adjusted to time the movement of disk 48 relative to the collapse of liner 50 following initiation of explosive material 29. By moving the initial position of disk 48 along longitudinal axis 26 toward the direction of the perforating jet, the impact of moving disk 48 on the perforating jet can be slowed. The disk has an outer peripheral surface that is smooth and ungrooved at and adjacent the aperture of the liner as illustrated in FIG. 3. In another embodiment of the invention as shown in FIG. 4, the thickness of disk 56 can be less than that of liner 50.

Figures 5, 6, 7, 8, 9:
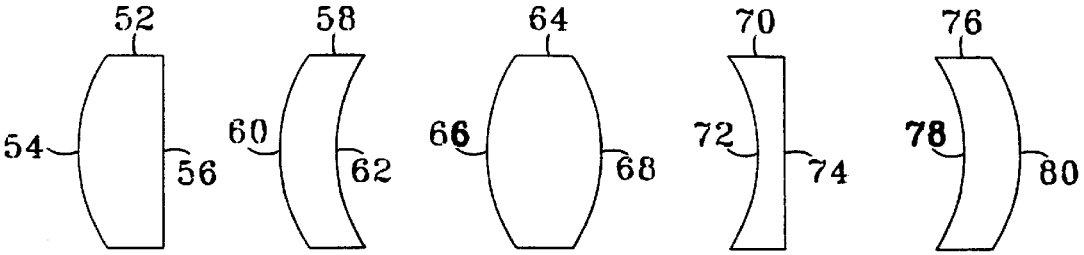
FIGS. 5–9 illustrate different configurations for disks having flat, concave, or convex surfaces.

FIGS. 5–9 illustrate other embodiment of a disk suitable to use in cooperation with a shaped charge liner. In FIG. 5, disk 52 has concave surface 54 and flat surface 56. In FIG. 6, disk 58 has concave surface 60 and concave surface 62. In FIG. 7, disk 64 has concave surface 66 and convex surface 68. In FIG. 8, disk 70 has convex surface 72 and flat surface 74. In FIG. 9, disk 76 has convex surface 78 and convex surface 80.

Figure 10:
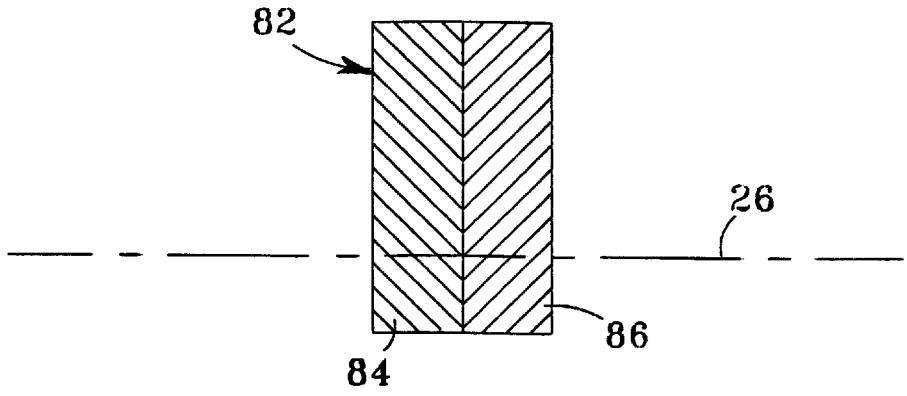
FIG. 10 illustrates a multiple material disk having axially positioned layers.
Figure 11:
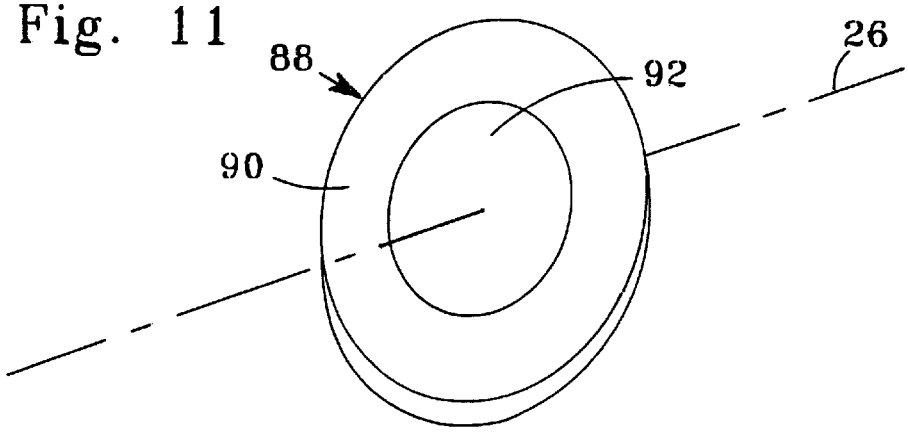
FIG. 11 illustrates a multiple material disk having radially positioned layers.
Figure 12:
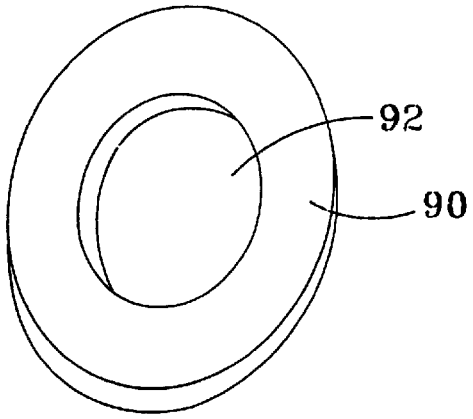
FIG. 12 illustrates a disk having an aperture through the disk middle section.

Disks such as disk 32 can be made with materials such as copper, from other metallic materials, from non-metallic materials, from solids or from pressed powders, or other components or combinations of components. The density of disk 32 can be greater or less than the liner density. The type of material forming disk 32 will affect the thickness and diameter of the optimal shape of the disk 32 and the desired location of disk 32 relative to the liner. Various combinations of materials are useful to accomplish different functions. FIG. 10 illustrates disk 82 having axially positioned layers 84 and 86, and FIG. 11 illustrates disk 88 having radially positioned layers 90 and 92. Other configurations and orientations of two or more materials are possible. Longitudinal axis 26 can bisect disk 32 or can be placed offset from the center of disk 32. As shown in FIG. 12, disk 90 can have aperture 92 through the interior of disk 90 to modify the shape and location of the perforating jet bulge.

Although the invention has been described in terms of certain preferred embodiments, it will become apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. An apparatus actuatable by a detonator to perforate a material, comprising:

an explosive material, explosion of which is initiated by the detonator to create a detonation wave;

a shaped liner proximate to said explosive material having a first end facing the detonator and having a second end formed about a longitudinal axis through a hollow space, wherein said shaped liner is collapsible about said hollow space when impacted by said detonation wave to form a material penetrating jet; and a metal disk within an aperture in said liner first end, wherein said disk comprises a front surface, a rear surface and an outer peripheral surface that is smooth and ungrooved at and adjacent said aperture, said outer peripheral surface connecting the front surface to the rear surface, wherein said rear surface and a portion of said outer peripheral surface extend into the explosive material and said front surface and a portion of said outer peripheral surface extend into the hollow space, said disk deformable by said detonation wave to modify the material penetrating jet by resisting radial movement of said collapsing liner towards said liner longitudinal axis and increasing hole size on material penetrated by the jet thereby, wherein the liner is in contact with said peripheral surface of the disk.

2. An apparatus as recited in claim 1, wherein said disk is substantially perpendicular to said liner longitudinal axis.

3. An apparatus as recited in claim 1, wherein said disk has two substantially parallel surfaces.

4. An apparatus actuatable by a detonator to perforate a material located downhole in a wellbore, comprising:

a housing;

a recess defined by an inner housing surface within said housing;

an explosive material within said recess, explosion of which is initiated by the detonator to create a detonation wave;

a shaped liner proximate to said explosive material having a first end facing the detonator and having a second end formed about a longitudinal axis through a hollow space, wherein said shaped liner is collapsible about said hollow space when impacted by said detonation wave to form a material penetrating jet; and a metal disk positioned within an aperture in said liner first end, wherein said disk comprises a front surface, a rear surface and an outer peripheral surface that is smooth and ungrooved at and adjacent said aperture, said outer peripheral surface connecting the front surface to the rear surface, wherein said rear surface and a portion of said outer peripheral surface extend into the explosive material and said front surface and a portion of said outer peripheral surface extend into said hollow space, said disk deformable by said detonation wave to modify the material penetrating jet by resisting radial movement of said collapsing liner toward said longitudinal axis and increasing hole size on the material formed by said jet, wherein the liner is in contact with said peripheral surface of the disk.

5. An apparatus as recited in claim 4, wherein said disk is integrally formed within said shaped liner.

6. An apparatus as recited in claim 4, wherein the width of said disk is greater than the width of said liner.

7. An apparatus as recited in claim 4, wherein said disk is formed with a material denser than the material forming said shaped liner.

8. An apparatus as recited in claim 4, wherein said disk is formed with a material less dense than the material forming said shaped liner.

9. An apparatus as recited in claim 4, wherein said disk is bisected by said longitudinal axis.

10. An apparatus as recited in claim 4, wherein the outer edge of said disk is circular.

* * * * *